US005923011A

United States Patent [19]

Sasaki et al.

[11] Patent Number: 5,923,011

[45] Date of Patent: Jul. 13, 1999

[54] CHATTER PREVENTING SWITCHING DEVICE HAVING MOVEMENT DETECTOR WITH CONTACT PIECE FOR TURNING ON/OFF ELECTRIC CONTACT

[75] Inventors: Hiroyuki Sasaki; Seiji Ohnuma, both of Shizuoka, Japan

[73] Assignee: Yazaki Corporation, Tokyo, Japan

[21] Appl. No.: 08/937,080

[22] Filed: Sep. 24, 1997

[30] Foreign Application Priority Data

Sep. 26, 1996 [JP] Japan ..... 8-254323

[51] Int. Cl.[6] ..... H01H 3/16

[52] U.S. Cl. ..... 200/61.41; 200/342

[58] Field of Search ..... 200/342, 61.41, 200/61.42, 61.53

[56] References Cited

U.S. PATENT DOCUMENTS 3,325,613 6/1967 Dunn et al. ..... 200/342 X 4,629,842 12/1986 Picot et al. ..... 200/342

*Primary Examiner*—Renee S. Luebke

*Attorney, Agent, or Firm*—Armstrong, Westerman, Hattori, McLeland & Naughton

[57] ABSTRACT

A switching device is provided which includes a moving body and a movement detection switch. The movement detection switch has a contact piece which is urged forwardly and which is moved by a spring so as to turn an electric contact on or off. When the moving body is shifted to a certain position, the electric contact is turned on or off through the contact piece. The moving body includes a floating head to be brought into contact with the contact piece, a guide for shifting the floating head in a moving direction of the contact piece, and a spring for urging the floating head in the moving direction of the contact piece. In a switching device of such a configuration, chattering can be prevented.

5 Claims, 3 Drawing Sheets

CHATTER PREVENTING SWITCHING DEVICE HAVING MOVEMENT DETECTOR WITH CONTACT PIECE FOR TURNING ON/OFF ELECTRIC CONTACT

BACKGROUND OF THE INVENTION

1. Field of the Invention

The present invention relates to a push-type switching device which turns on/off an electric contact when a moving body moves to a certain position with respect to a movement detection switch.

2.Description of the Prior Art

FIG. 3A is a perspective view of a conventional push-type switching device, generally a. FIG. 3B is a side view of a movement detection switch. In FIG. 3A, reference numeral 1 denotes a movement detection switch and reference numeral 2 denotes a moving body. As seen from FIG. 3A, the movement detection switch 1 is fastened onto the wall of an electric appliance by a fastening flange 14. The moving body 2 moves in a direction of the movement detection switch 1 by a moving mechanism (not shown).

As seen from FIG. 3B, the movement detection switch 1 is provided with a contact piece 11 for turning on/off an electric contact (not shown), a spring 12 for urging the contact piece 11 forward, and connecting terminals 13 connected to the electric contact.

The movement detection switch 1 is on/off controlled in such a manner that when an abutting fragment mounted on the moving body hits on the contact piece 11 of the movement detection switch 1, it pushes to move the contact piece 11, thereby turning on/off the electric contact.

FIG. 4A is a view for explaining the states when the electric contact of the above switching device falls in an ON state and an OFF state.

As described above, in order that the electric contact falls into the ON or OFF state, the abutting fragment 26 is brought into contact with the contact piece 11 so that the contact piece 11 is pushed, and the contact piece 11 must move over a certain distance.

Therefore, when the contact piece 11 moves over the position where the electric contact falls into the ON or OFF state, no problem occurs. But, when the contact piece 11 has moved to the changing point of ON or OFF, "chattering" will occur.

For example, when the contact piece 11 moves due to vibration, as shown in FIG. 4A, the abutting fragment 26 and contact piece 11 are separated from each other so that the ON state of the electric contact becomes the OFF state as illustrated by ① and ③. Otherwise, they will be brought into contact with each other again, resulting in the ON state as illustrated by ②.

FIG. 5 is an application example of the switching device a. For example, in a motor driving circuit b, for an electric vehicle, the switching device a is arranged between a battery 41 and an axle shaft driving motor 42, and is used to interrupt the circuit b manually in battery exchange or motor malfunction.

Specifically, in a switch box 43, the switching device is used as a switch $\mathbf{44}_3$ for a pilot lamp 46 which informs a driver of whether the box 43 is ON or OFF by an indicator 45 in a meter. This switch $\mathbf{44}_3$ is used in mechanical synchronism with the motor switches $\mathbf{44}_1$ and $\mathbf{44}_2$. Therefore, the chattering in the switching device a must be prevented.

SUMMARY OF THE INVENTION

An object of the present invention is to provide a switching device which does not generate chattering.

In accordance with the present invention, there is provided a switching device comprising a moving body and a movement detection switch having a contact piece urged forward and moved by a spring so as to turn an electric contact on or off, wherein when said moving body is shifted to a certain position, the electric contact is turned on or off through said contact piece, said moving body comprising:

a floating head to be brought into contact with said contact piece; a guide for shifting the floating head in a moving direction of said contact piece; and a spring for urging the floating head in a moving direction of the contact piece.

In the configuration described, the floating head is provided on a face of the moving body, which floating head is to be brought into contact with the movement direction switch, and it is urged, in the guide, in the direction of the contact piece by the spring.

Therefore, should the relative location of the moving body and the movement detection switch vary, the spring urges the floating head against the movement detection switch, so as to prevent chattering.

Preferably, said moving body comprises a receiver for receiving the spring and urging the contact piece in a moving direction of the contact piece. The guide comprises a stopper for preventing the floating head from being removed from the moving body owing to urging by the spring. In such a preferable configuration, even when the moving body is greatly separated from the movement detection switch, the moving body can be prevented from being removed from the spring and floating head.

The above and other objects and features of the present invention will be more apparent from the following description taken in conjunction with the accompanying drawings.

DESCRIPTION OF THE PREFERRED EMBODIMENTS

Figure 1:
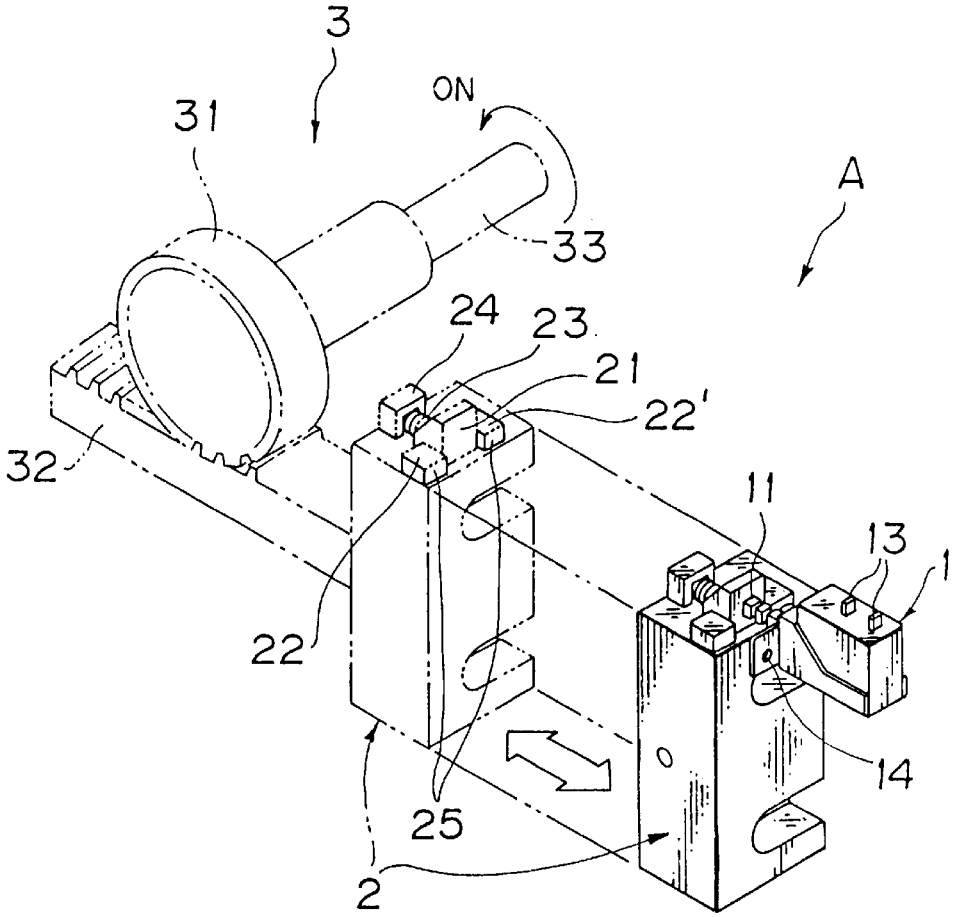
FIG. 1 is a perspective view of a push-type switching device according to the present invention.
Figure 5:
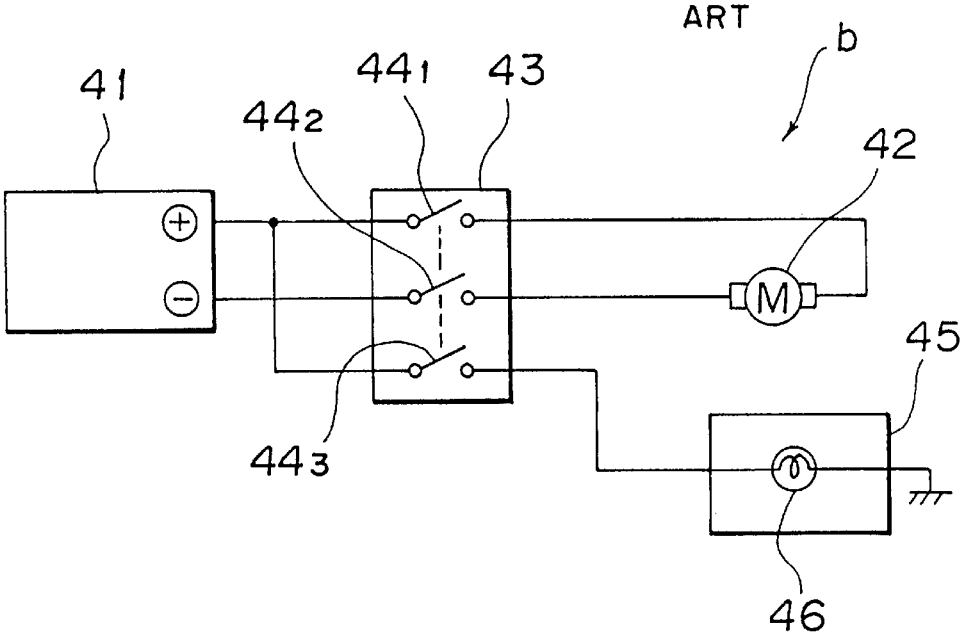
FIG. 5 PRIOR ART
FIG. 5 is an explanation view of an application of the push-type switching device in FIGS. 3A and 3B.

Now referring to the drawings, an explanation will be given of the embodiment of the present invention.

Figure 2A:
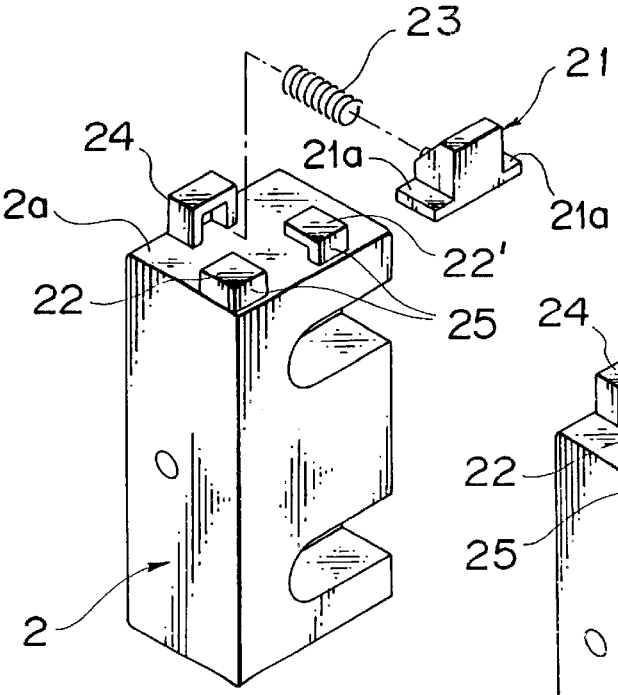
FIGS. 2A and 2B are an exploded perspective view of the main part of FIG. 1, and a perspective view of the assembled state thereof, respectively.
Figure 2B:
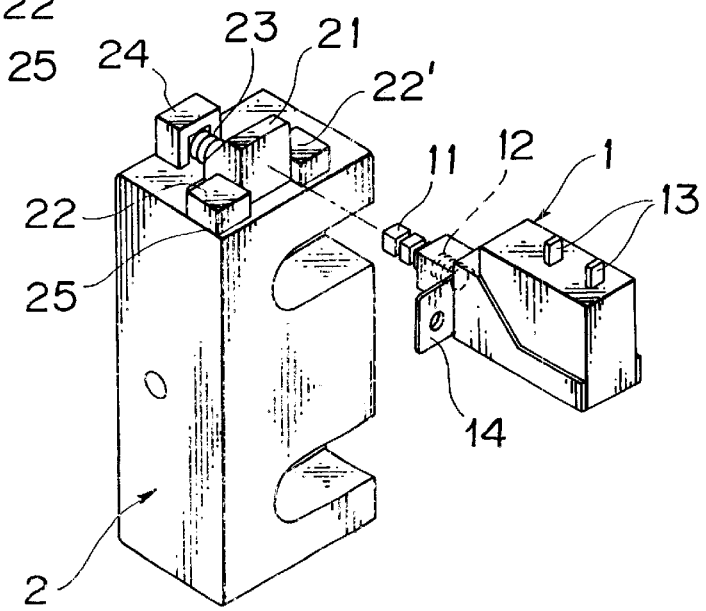

FIG. 1 is a perspective view of a push-type switching device according to the present invention; and FIGS. 2A and 2B are an exploded perspective view of the main part of FIG. 1, and a perspective view of the assembled state thereof, respectively.

In these figures, a switching device, generally A includes a movement detection switch 1, a moving body 2 and a moving mechanism 3. The movement detection switch 1 is provided with a contact piece 11 urged forward by a spring 12, a pair of connecting terminals 13 connected to electric contacts (not shown) inside and a fastening flange 14. The movement detection switch 1 is fastened to the wall of an electric appliance.

The moving body 2 is connected to the one end of a rack 32 constituting a moving mechanism 3. The rack 32 reciprocates by back-and-forth rotation of a pinion 31. Namely, the moving body 2 moves in opposition to the movement detection switch 1 by a pinion shaft 33.

The moving body 2 moves in a direction of the movement detection switch 1. When the contact piece 11 is pushed and moved, as explained in connection with the prior art, the electric contact not shown turns on or off.

Figure 3A:
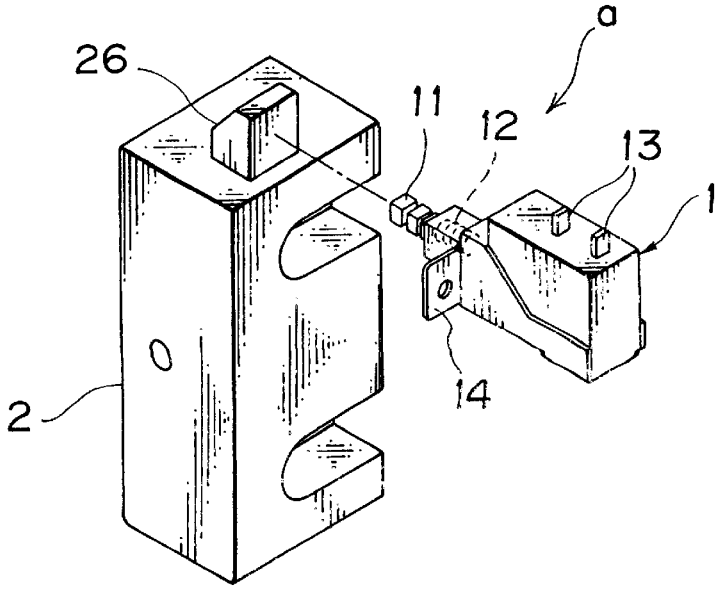
FIG. 3 A PRIOR ART
FIGS. 3A and 3B are a perspective view of a conventional push-type switching device and a side view of a movement detection switch, respectively.
Figure 3B:
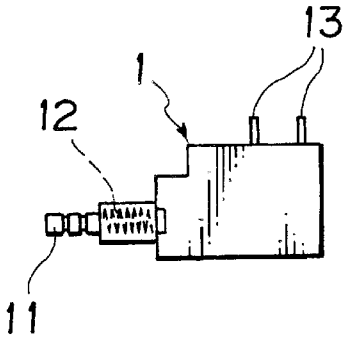
FIG. 3 B PRIOR ART

Although the above structure is the same as that shown in FIGS. 3A and 3B, in the present invention, a floating head (hereinafter referred to as simply "head") 21, in place of the abutting fragment 26, is movably mounted on the upper face 2*a* of the moving body 2.

The head 21 has leg pieces 21*a* on both sides, and these leg pieces 21*a* are guided by guides 22 and 22' for smoothly moving the head 21 in a moving direction of the contact piece 11. Reference numeral 23 denotes a spring for urging the head 21 toward the contact piece 11. Reference numeral 24 denotes a receiver for receiving a spring 23.

Each of the guides 22 and 22' is provided with a stopper for preventing the head 21 from springing out due to urging of the spring 23.

In the above configuration shown in FIG. 1, when a pinion shaft 33 rotates in an arrow ON, the moving body 2 moves towards the movement detecting switch 1 through the rack 32.

Figure 4B:
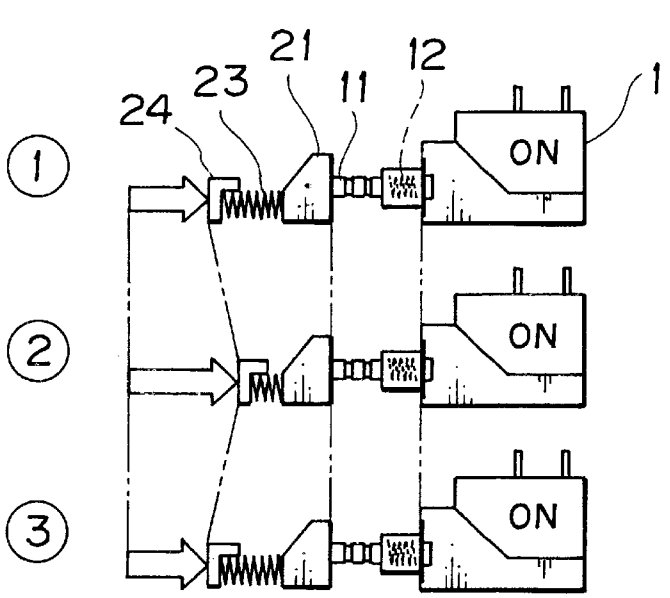
FIGS. 4A and 4B are views for explaining the switching operation in a prior art and the present invention, respectively.
Figure 4A:
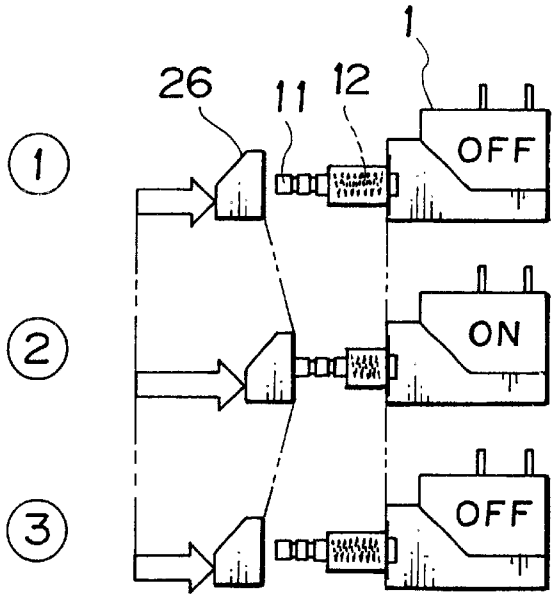
FIG. 4 A PRIOR ART

Now, it is assumed that by this movement, the head 21 hits on the contact piece 11 and pushes it, and the electric contact has reached to the vicinity of the position where the electric contact falls into the ON or OFF state. In this case, as shown by ① or ③ in FIG. 4B, even if the receiver 24 moves due to vibration of the moving body 2, the movement will be absorbed by the spring 23. Therefore, the head 21 does not move so that the electric contact (not shown) maintains its ON or OFF state.

Namely, abrupt movement and short periodic movement of the moving body 2 is absorbed by the spring 23 so that the head 21 remains still. On the other hand, long periodic movement of the moving body 2 is not absorbed by the spring 23. Then, the head 21 moves to the position where the urging force of the spring 23 and that of the spring 12 of the movement detection switch 1 are balanced, thereby turning on or off the electric contact (not shown).

In the embodiment described above, the moving body 2 has been moved by the moving mechanism 3 composed of the pinion 31 and the rack 32. But, the moving body 2 may be moved by the sliding/fixing means such as an adjusting screw using a ball-nut.

What is claimed is:

1. A switching device comprising:

a moving body; and a movement detection switch having a contact piece urged forwardly and moved by a spring so as to turn an electric contact on or off, wherein when said moving body is shifted to a certain position, said electric contact is turned on or off through said contact piece, said moving body comprising:

a floating head, positioned on a face of said moving body, to be brought into contact with said contact piece of said movement detection switch;

a guide for guiding said floating head to move along said face in a direction of said contact piece, wherein said floating head includes a pair of leg pieces for cooperation with said guide; and a spring for urging said floating head in said direction of said contact piece, wherein when the relative location of said moving body and said movement detection switch varies, the spring urges said floating head along said face against said movement detection switch so as to prevent chattering.

2. The switching device according to claim 1, wherein said guide comprises a stopper for preventing said floating head from being removed from said moving body because of urging by said spring.

3. The switching device according to claim 1, wherein said moving body includes a receiver for receiving said spring which spring urges said floating head in said direction of said contact piece.

4. The switching device according to claim 3, wherein said guide comprises a stopper for preventing said floating head from being removed from said moving body because of urging by said spring.

5. The switching device according to claim 1, wherein said guide includes two separate guide portions.

* * * * *